US007306098B1

(12) United States Patent
Rineer, Jr.

(10) Patent No.: US 7,306,098 B1
(45) Date of Patent: Dec. 11, 2007

(54) TOOTHBRUSH COVERING AND METHOD

(76) Inventor: Lawrence E. Rineer, Jr., 43 Bethesda Church Rd. East, Holtwood, PA (US) 17532

( * ) Notice: Subject to any disclaimer, the term of this patent is extended or adjusted under 35 U.S.C. 154(b) by 543 days.

(21) Appl. No.: 11/005,372

(22) Filed: Dec. 6, 2004

(51) Int. Cl.
*A47G 29/08* (2006.01)

(52) U.S. Cl. ..... 206/362.1; 312/207

(58) Field of Classification Search ..... 206/362.1, 206/372, 581, 362.2, 362.3, 15.2, 15.3; 312/206, 312/207; D6/534; 132/308, 310; 248/309.1, 248/312
See application file for complete search history.

(56) References Cited

U.S. PATENT DOCUMENTS 1,205,311 A * 11/1916 Wybaillie ..... 312/207
1,992,564 A * 2/1935 Amdur ..... 312/31
2,148,043 A * 2/1939 Zero ..... 312/206
2,549,115 A 4/1951 Mote
2,608,294 A 8/1952 Ward
2,808,306 A * 10/1957 Schilling ..... 312/207
2,950,946 A * 8/1960 Starworth ..... 312/207
2,956,851 A 10/1960 Merendino
3,977,743 A 8/1976 Harris
D398,177 S 9/1998 Garcia
6,119,854 A 9/2000 Prentice et al.
2001/0023837 A1 9/2001 Brown

* cited by examiner

*Primary Examiner*—Mickey Yu
*Assistant Examiner*—Steven A. Reynolds

(57) ABSTRACT

A toothbrush covering and method includes a toothbrush holder attached to and extending outwardly from a vertical surface. At least one toothbrush is removably held in the toothbrush holder so that a head of the toothbrush extends above the toothbrush holder. A housing has a front wall, a back wall, a first side wall and a second side wall. The housing has a door portion that is separable from the housing. A hinge hingedly couples the door portion to the housing. An adhesive is attached to an outer surface of the back wall. The back wall is attached to the vertical surface and above the toothbrush holder so that the toothbrush holder is positioned in the housing and the head is positioned between the toothbrush holder and the top wall. The door is closed for covering the head or opened for removing the toothbrush.

5 Claims, 5 Drawing Sheets

TOOTHBRUSH COVERING AND METHOD

BACKGROUND OF THE INVENTION

1. Field of the Invention

The present invention relates to toothbrush covering devices and more particularly pertains to a new toothbrush covering device for protecting a toothbrush from airborne germs and particles.

2. Description of the Prior Art

The use of toothbrush covering devices is known in the prior art. U.S. Pat. No. 2,956,851 describes a toothbrush holder that includes a covering which is attachable to the holder so that toothbrush heads are covered. Another type of toothbrush covering device is U.S. Pat. No. 2,549,115 having a housing that is attachable to a wall and which includes a plurality of slots in a bottom wall for receiving toothbrushes. An upper portion of the housing covers the toothbrushes. A similar device is found in U.S. patent No. application 2001/0023837.

While these devices fulfill their respective, particular objectives and requirements, the need remains for a device that can be retrofitted to existing, conventional toothbrush holders. The device should be attachable directly to a wall and over the toothbrush holder to protect toothbrushes from germs, hair, chemicals and other airborne debris.

SUMMARY OF THE INVENTION

The present invention meets the needs presented above by comprising a toothbrush holder attached to and extending outwardly from a vertical surface. At least one toothbrush is removably held in the toothbrush holder so that a head of the toothbrush extends above the toothbrush holder. A housing has a front wall, a back wall, a first side wall, a second side wall, a top wall and an open bottom. The back wall has a height less than a height of the front wall. The housing has a break therein to define a door portion that is separable from the housing. A hinge hingedly couples the door portion to the housing. An adhesive is attached to an outer surface of the back wall. The back wall is attached to the vertical surface and above the toothbrush holder so that the toothbrush holder is positioned in the housing and the head is positioned between the toothbrush holder and the top wall. The door is closed for covering the head or opened for removing the toothbrush.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
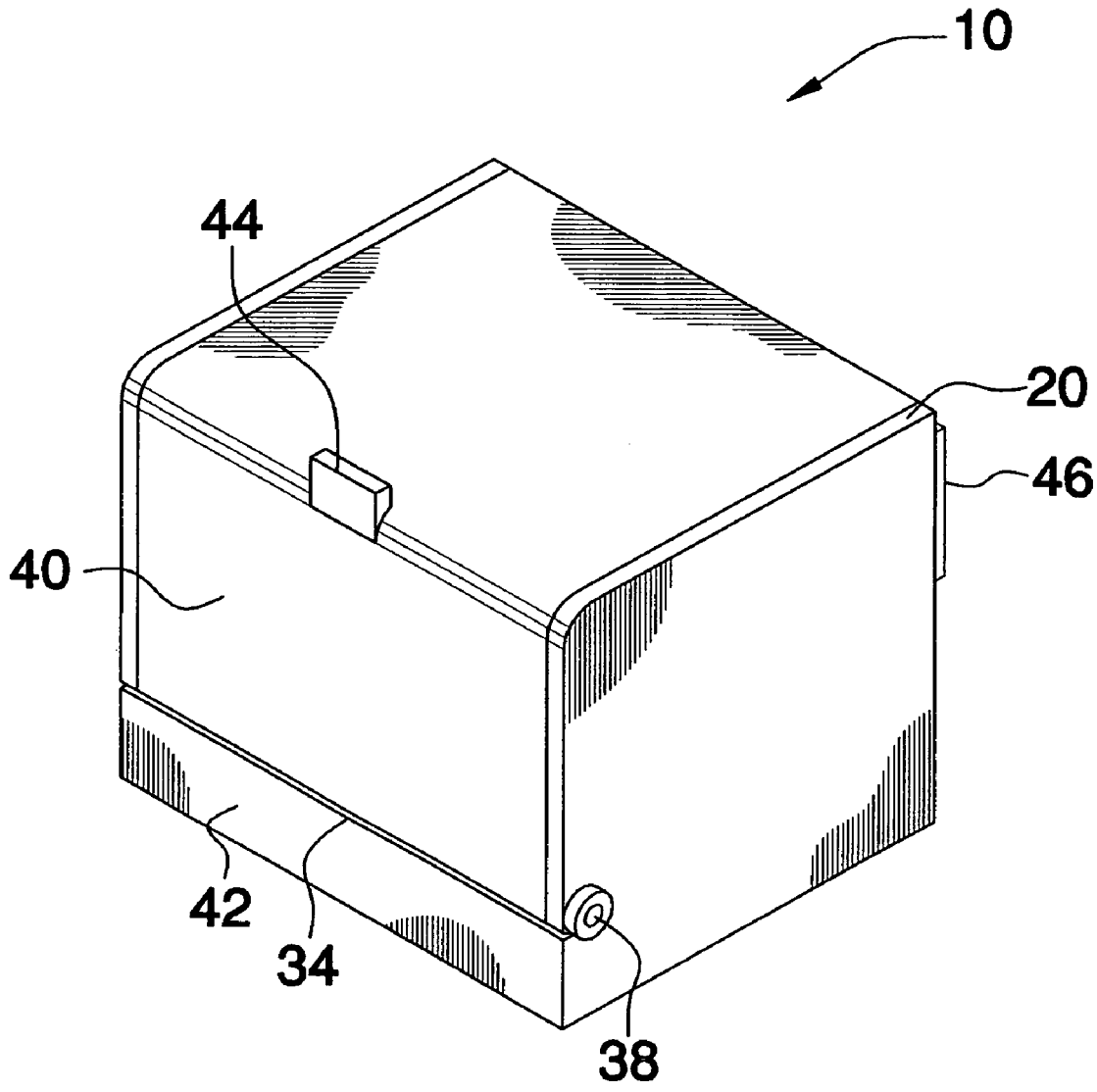
FIG. 1 is a perspective view of a toothbrush covering and method according to the present invention.
Figure 2:
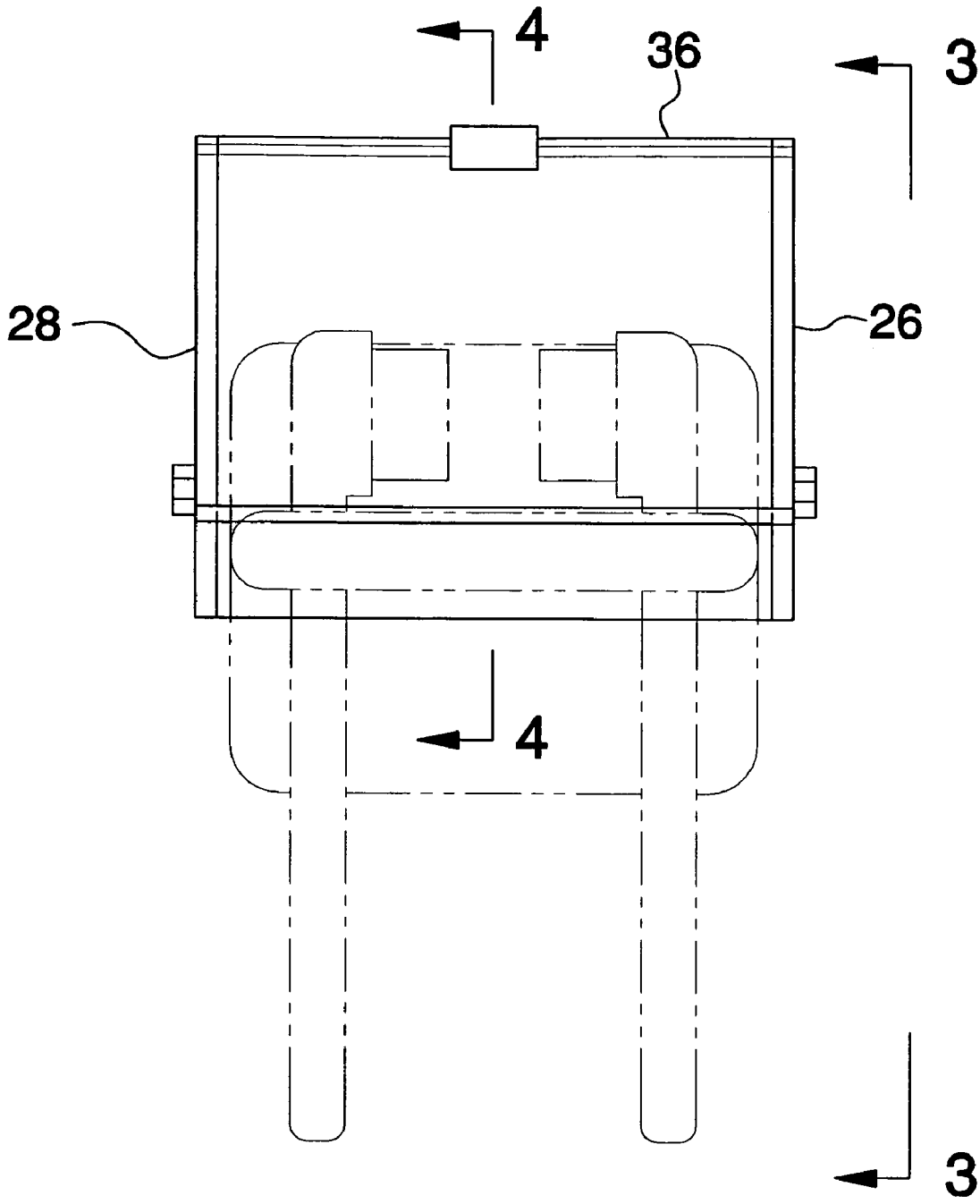
FIG. 2 is a front view of the present invention.
Figure 3:
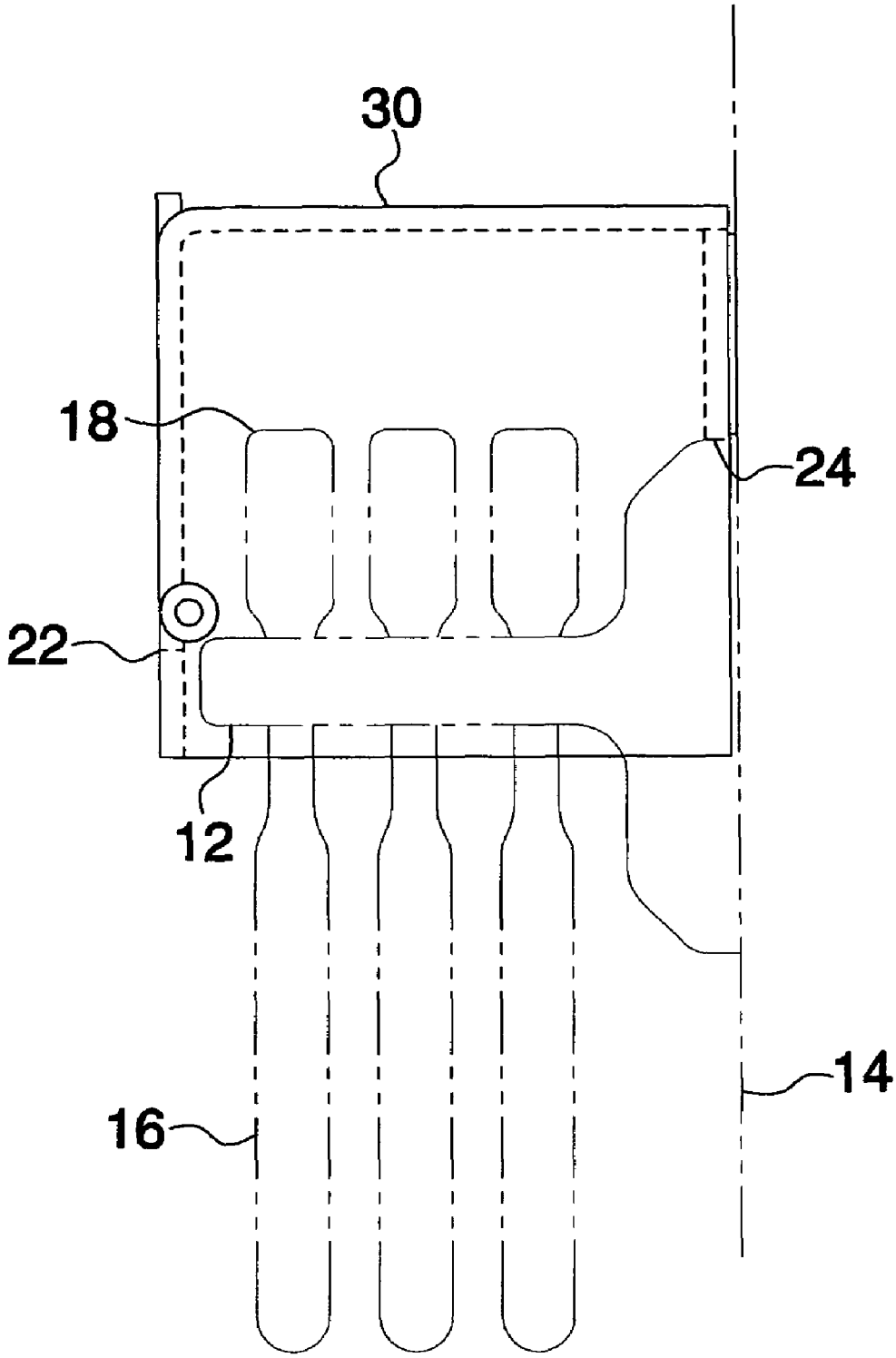
FIG. 3 is a side view of the present invention.
Figure 4:
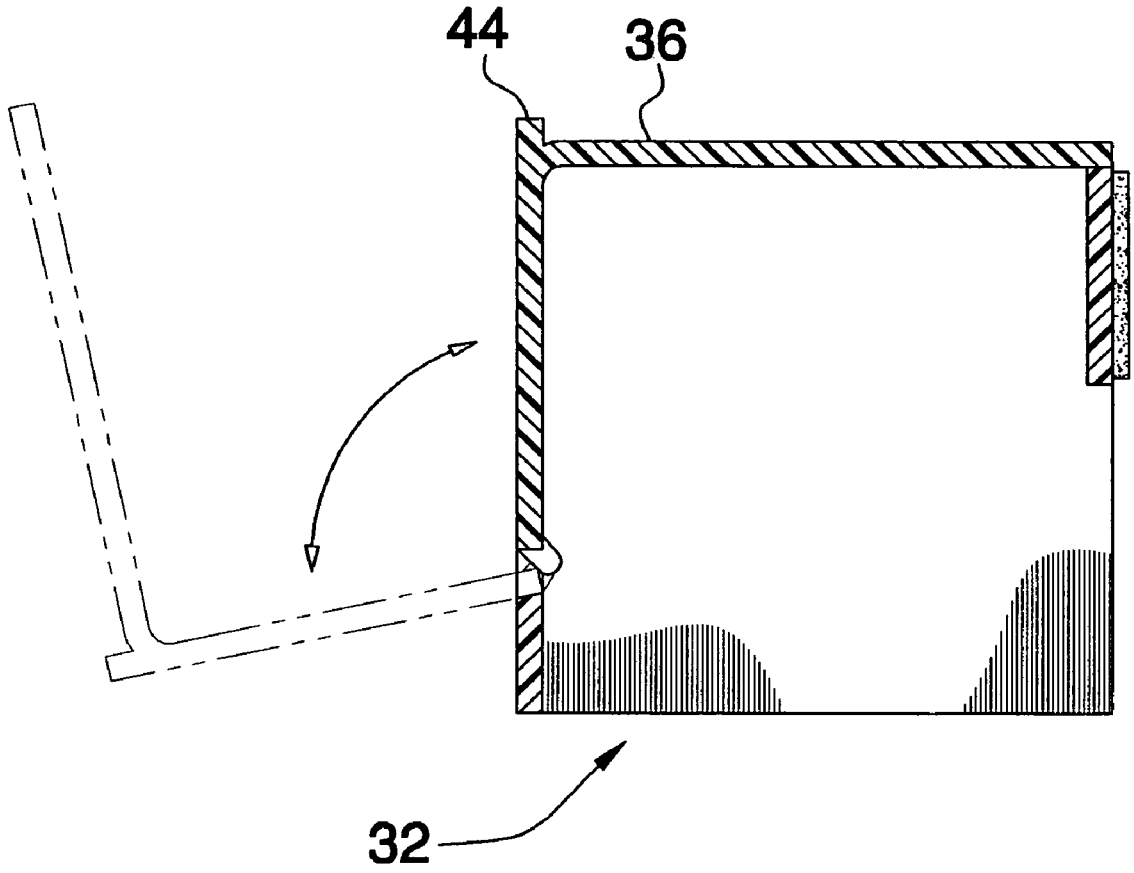
FIG. 4 is a cross-sectional view taken along line 4-4 of FIG. 2 of the present invention.

With reference now to the drawings, and in particular to FIGS. 1 through 5 thereof, a new toothbrush covering device embodying the principles and concepts of the present invention and generally designated by the reference numeral 10 will be described.

As best illustrated in FIGS. 1 through 5, the toothbrush covering and method 10 generally includes a conventional toothbrush holder 12 that is attached to and extends outwardly from a vertical surface 14. At least one toothbrush 16 is removably held in the toothbrush holder 14 so that a head 18 of the toothbrush 16 extends above the toothbrush holder 12.

Figure 5:
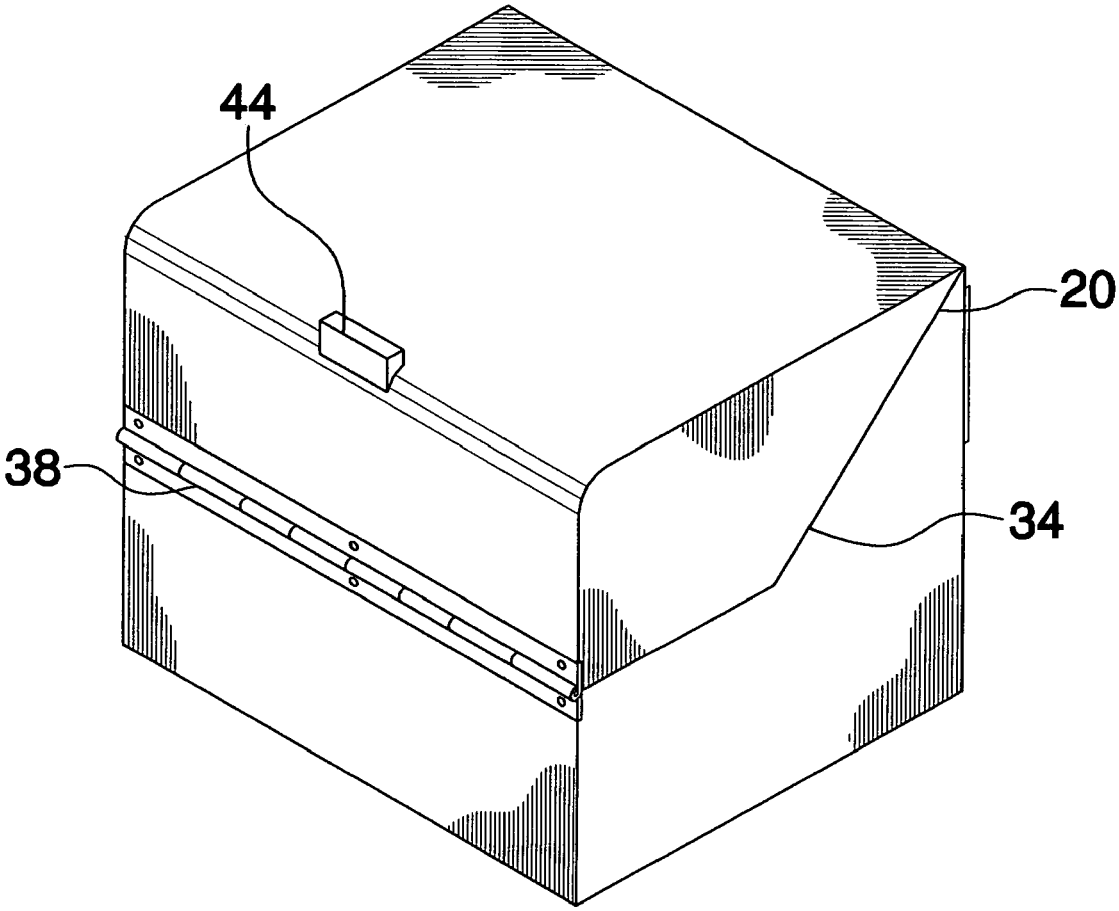
FIG. 5 is a perspective view of a second embodiment of the present invention.

A housing 20 has a front wall 22, a back wall 24, a first side wall 26, a second side wall 28, a top wall 30 and an open bottom 32. The back wall 24 has a height extending downwardly from the top wall that is less than a height of the front wall 22. The housing 20 has a break 34 therein to define a door portion 36 that is separable from the housing 20. A hinge 38 hingedly couples the door portion 36 to the housing 20. The door portion 36 at least includes an upper portion 40 of the front wall 22 and the top wall 30. The door portion 36 may also include upper portions of the first 26 and second 28 side walls. The break 34 extends along a juncture of the top 30 and back 24 walls. The hinge 38 hingedly couples the upper portion 40 of the front wall 22 to a lower portion 42 of the front wall 22 so that the top wall 30 is selectively pivotable upwardly and outwardly away from the housing 20. FIGS. 1 and 5 show different examples of hinges 38. The housing 20 has a height generally between 2 inches and 4 inches, a width less than 6 inches and a depth less than 6 inches. A gripping member 44, such as a tab, is attached to the door portion 36 and is positioned adjacent to a juncture of the top 30 and front 22 walls. A pressure sensitive adhesive 46 is attached to an outer surface of the back wall 24.

The back wall 24 of the housing 20 is attached to the vertical surface 14 and above the toothbrush holder 12 so that the toothbrush holder 12 is positioned in the housing 30 and the head 18 of the toothbrush 16 is positioned between the toothbrush holder 12 and the top wall 30. The door 36 is closed to cover the head 18 or opened for removing the toothbrush 16 from the toothbrush holder 12.

In use, the covering is placed over the toothbrush holder 12 to protect the toothbrush 16 from airborne germs, chemicals, hair and other particles. The door 36 may be opened when a person desires to retrieve their toothbrush 16. Airflow around the open bottom side 32 of the housing 20 dries out the toothbrush 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of covering a toothbrush comprising the steps of:

providing a toothbrush holder attached to and extending outwardly from a vertical surface;

providing at least one toothbrush being removably held in said toothbrush holder such that a head of said toothbrush extends above said toothbrush holder;

providing a housing having a front wall, a back wall, a first side wall, a second side wall, a top wall and an open bottom, said back wall having a height less than a height of said front wall, said housing having a break therein to define a door portion being separable from said housing, a hinge hingedly coupling said door portion to said housing;

providing an adhesive being attached to an outer surface of said back wall;

attaching said back wall to said vertical surface and above said toothbrush holder such that said toothbrush holder is positioned in said housing and said head is positioned between said toothbrush holder and said top wall; and closing said door for covering said head or opening said door for removing said toothbrush.

2. The method according to claim 1, wherein said door portion at least includes an upper portion of said front wall and said top wall, said hinge hingedly coupling said upper portion of said front wall to a lower portion of said front wall such that said top wall is selectively pivotable upwardly and outwardly away from said housing.

3. The method according to claim 2, further providing a gripping member being attached to said door, said gripping member being positioned adjacent to a juncture of said top and front walls.

4. The method according to claim 1, further providing a gripping member being attached to said door, said gripping member being positioned adjacent to a juncture of said top and front walls.

5. A method of covering a toothbrush comprising the steps of:

providing a toothbrush holder attached to and extending outwardly from a vertical surface;

providing at least one toothbrush being removably held in said toothbrush holder such that a head of said toothbrush extends above said toothbrush holder;

providing a housing having a front wall, a back wall, a first side wall, a second side wall, a top wall and an open bottom, said back wall having a height less than a height of said front wall, said housing having a break therein to define a door portion being separable from said housing, a hinge hingedly coupling said door portion to said housing, said door portion including an upper portion of said front wall and said top wall, said hinge hingedly coupling said upper portion of said front wall to a lower portion of said front wall such that said top wall is selectively pivotable upwardly and outwardly away from said housing, said housing having a height generally between 2 inches and 4 inches;

providing a gripping member being attached to said door, said gripping member being positioned adjacent to a juncture of said top and front walls;

providing an adhesive being attached to an outer surface of said back wall;

attaching said back wall to said vertical surface and above said toothbrush holder such that said toothbrush holder is positioned in said housing and said head is positioned between said toothbrush holder and said top wall; and closing said door for covering said head or opening said door for removing said toothbrush.

* * * * *